US007694716B2

(12) United States Patent
Lonardi et al.

(10) Patent No.: US 7,694,716 B2
(45) Date of Patent: Apr. 13, 2010

(54) CONTINUOUS CASTING MOLD WITH OSCILLATION DEVICE

(75) Inventors: Emile Lonardi, Bascharage (LU); Michel Houbart, Amay (BE); Charles Assa, Dondelange (LU); Marc Wies, Dudelange (LU)

(73) Assignee: SMS Siemag Aktiengellschaft, Duesseldorf (DE)

( * ) Notice: Subject to any disclaimer, the term of this patent is extended or adjusted under 35 U.S.C. 154(b) by 126 days.

(21) Appl. No.: 11/630,754

(22) PCT Filed: Jun. 15, 2005

(86) PCT No.: PCT/EP2005/052773

§ 371 (c)(1),
(2), (4) Date: Dec. 22, 2006

(87) PCT Pub. No.: WO2006/003084

PCT Pub. Date: Jan. 12, 2006

(65) Prior Publication Data

US 2007/0246186 A1 Oct. 25, 2007

(30) Foreign Application Priority Data

Jun. 25, 2004 (LU) ..... 91086

(51) Int. Cl.
*B22D 11/053* (2006.01)

(52) U.S. Cl. ..... 164/416; 164/478

(58) Field of Classification Search ..... 164/416
See application file for complete search history.

(56) References Cited

U.S. PATENT DOCUMENTS 4,729,422 A * 3/1988 Ernst et al. ..... 164/465
4,732,209 A * 3/1988 Apostolou et al. ..... 164/475
5,676,194 A * 10/1997 Petry et al. ..... 164/416
6,298,905 B1 * 10/2001 Kaell et al. ..... 164/416

FOREIGN PATENT DOCUMENTS

WO 0236290 5/2002

* cited by examiner

*Primary Examiner*—Kuang Lin
(74) *Attorney, Agent, or Firm*—Abelman, Frayne & Schwab

(57) ABSTRACT

A continuous casting mould comprises a mould tube (12), a mould jacket (24) surrounding the mould tube (12), a cooling system (26) within the mould jacket (24) for cooling the mould tube (12), an oscillating lever (40) supporting the mould tube (12). The oscillating lever (40) is capable of oscillating about a pivoting axis (45) substantially perpendicular to a casting plane containing the casting axis (20) for transmitting mechanical oscillations to the mould tube (12). An oscillating mould cover (30) associated with the top end of the mould jacket (24). The mould tube (12) is supported with its upper end by the oscillating mould cover (30), and is itself pivotably supported by the oscillating lever (40) outside of the mould jacket (24). A sealing element, e.g. an annular lip seal (90), provides sealing between the oscillating mould cover (30) and the top end of the mould jacket (24).

13 Claims, 3 Drawing Sheets

CONTINUOUS CASTING MOLD WITH OSCILLATION DEVICE

INTRODUCTION

Figure 1:
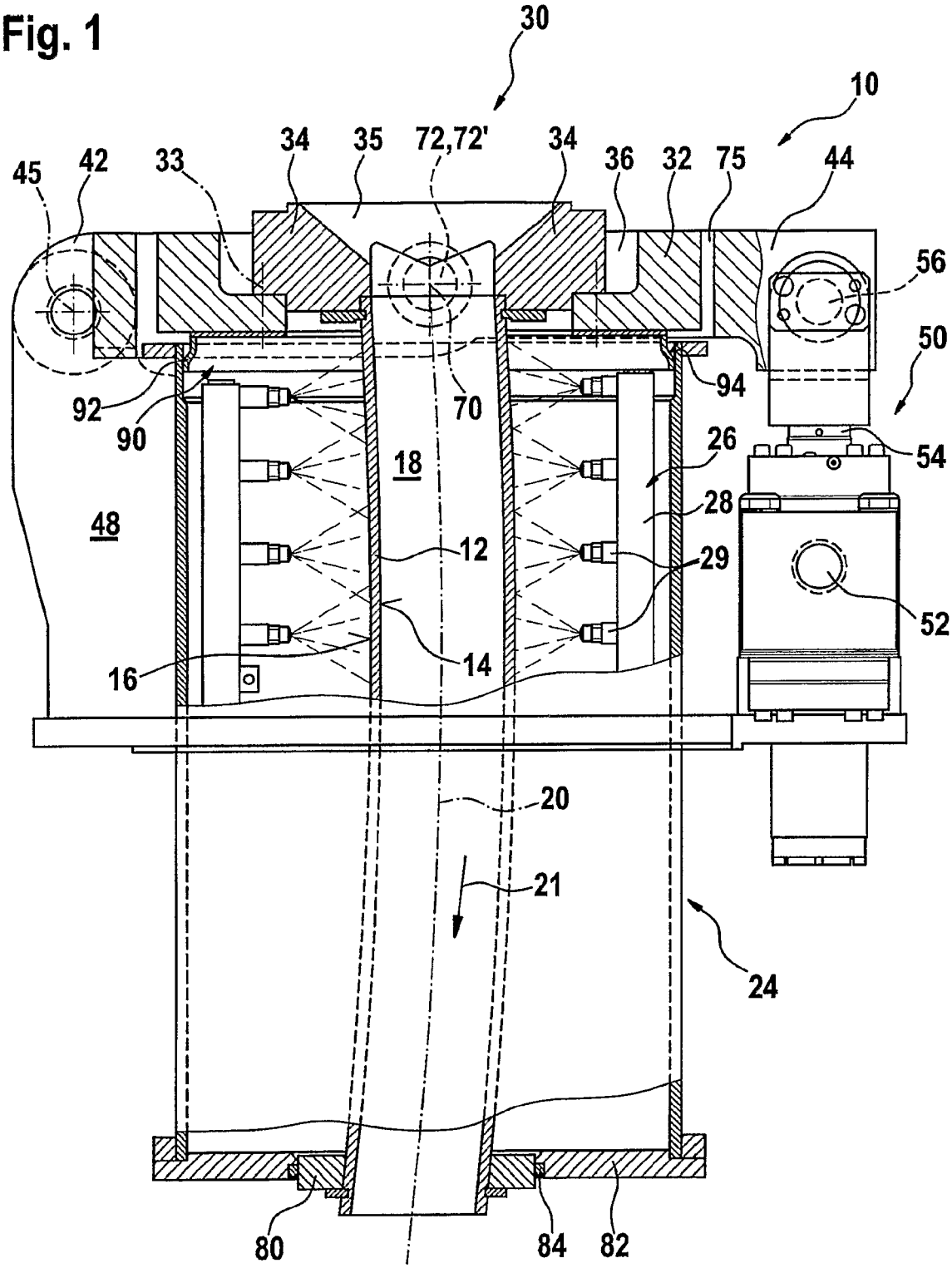

The present invention relates to a continuous casting mould with an oscillation device.

A continuous casting mould typically consists of a mould tube for channeling a molten metal, a cylindrical mould jacket defining a cooling chamber around the mould tube and a cooling system enclosed within this cooling chamber for cooling the mould tube. During continuous casting, the molten metal solidifies in contact with the inner surface of the cooled mould tube and forms a peripheral crust. An attachment or sticking of the solidified peripheral crust to the inner surface of the mould tube would cause the peripheral crust to tear. A well-known solution to reduce this risk is to subject the continuous casting mould to mechanical oscillations along the casting axis.

In order to produce an oscillatory movement of the continuous casting mould, it is know to put the latter on an oscillating table. It follows that the whole of the casting mould, including the mould tube, the mould jacket with the mould cooling system and possibly an electromagnetic inductor, i.e. a considerable mass, must be oscillated with a frequency of the order of 5 Hz and higher and an amplitude of several millimeters.

In order to reduce the mass to be oscillated, it is known to connect an oscillation device directly to the mould tube and to oscillate the latter within the mould jacket, which remains stationary. Such a solution is e.g. disclosed in U.S. Pat. No. 5,676,194 assigned to same applicant. In this prior art mould, an oscillation generation device is connected to the mould tube via a double-armed oscillating lever. Sealing diaphragms are connected between the stationary mould jacket and the mould tube, so as to allow an axial oscillation of the mould tube, while ensuring the sealing of a pressurized cooling chamber around the mould tube. The oscillating lever, which is supported by the mould jacket, supports with one arm the mould tube within the mould jacket and is connected with the other arm to a hydraulic cylinder located outside of the mould jacket. A drawback of the latter solution is that the oscillating lever must be introduced through a sealed passage in the mould jacket into the cooling chamber. Furthermore, the oscillating lever traversing the cooling chamber perturbs the cooling of the upper end of the mould tube.

OBJECT OF THE INVENTION

The object of the present invention is to provide an improved continuous casting mould with oscillation mechanism. This object is achieved by a continuous casting mould as claimed in claim 1.

GENERAL DESCRIPTION OF THE INVENTION

A continuous casting mould in accordance with the invention comprises—in a manner known per se—a mould tube forming a casting channel along a casting axis, a mould jacket surrounding the mould tube, a cooling system within the mould jacket for cooling the mould tube and an oscillating lever supporting the mould tube. For transmitting mechanical oscillations to the mould tube, the oscillating lever is capable of oscillating about a pivoting axis substantially perpendicular to a casting plane containing the casting axis. In accordance with the present invention, the continuous casting mould further comprises an oscillating mould cover associated with the top end of the mould jacket. The mould tube is supported with its upper end by the oscillating mould cover, which is pivotably supported by the oscillating lever outside of the mould jacket. A sealing element provides sealing between the oscillating mould cover and the top end of the mould jacket. It will be appreciated that in a continuous casting mould in accordance with the invention, the oscillated mass is reduced to the total mass of the mould tube and the mould cover. Furthermore, as the oscillating lever is connected to the oscillating mould cover outside the mould jacket, the cooling of the upper end of the mould tube is not perturbed and there is no need for a complicated sealed passage in the mould jacket for the oscillating lever.

The oscillating mould cover is advantageously supported by the oscillating lever so as to be capable of pivoting about a pivoting axis that is substantially parallel to the pivoting axis of the oscillating lever, whereby the oscillating mould cover remains parallel to itself when the oscillating lever pivots about its pivoting axis.

A very compact and efficient design of the continuous casting mould is achieved, if the oscillating mould cover is located above the mould jacket and the oscillating lever has a central ring-shaped part in which the oscillating mould cover is pivotably supported. This oscillating lever then has, on one side of the central ring-shaped part, supporting arms and, on the opposite side thereof, an actuation arm. Pivot bearings are located laterally of the mould jacket, wherein the supporting arms are mechanically connected to the pivot bearings, so as to define the pivoting axis for the oscillating lever. An oscillating device is arranged outside the mould jacket at the opposite side of the pivot bearings and connected to the actuation arm of the oscillating lever.

The oscillating device is advantageously a linear actuator that is pivotably supported outside the mould jacket and connected via an articulated joint to the actuation arm of the oscillating lever.

In a preferred embodiment, the mould cover comprises an annular mould bearing that is pivotably supported by the oscillating lever and a support flange to which the upper end of the mould tube is affixed. This support flange is arranged in a central cavity of the annular mould bearing and removably affixed thereto. The support flange advantageously comprises a massive block forming a kind of central inlet funnel for the mould tube.

If the cooling system is a spray cooling system, the sealing element is advantageously an annular lip seal. The latter annular lip seal is preferably affixed to the oscillating mould cover and has a free resilient rim that is radially pushed against a cylindrical inner wall of the mould jacket. Alternatively, the annular lip seal may also be affixed to the mould jacket and have a free resilient rim that is radially pushed against a cylindrical surface of the oscillating mould cover.

At its bottom end, such a continuous casting mould advantageously comprises a ring element affixed to the lower end of the mould tube, and a bottom plate connected to the bottom end of the mould jacket, wherein the bottom plate includes a central opening in which the ring element is arranged. In a preferred embodiment of continuous casting mould with spray cooling, a graphite ring forms, within the central opening, an annular contact and guide surface between the ring element bottom plate.

If the cooling system is a continuous-flow cooling system the sealing element is preferably an annular diaphragm mounted in a sealed manner between the mould cover and the top end of the mould jacket.

DETAILED DESCRIPTION WITH RESECT TO THE FIGURES

Figure 2:
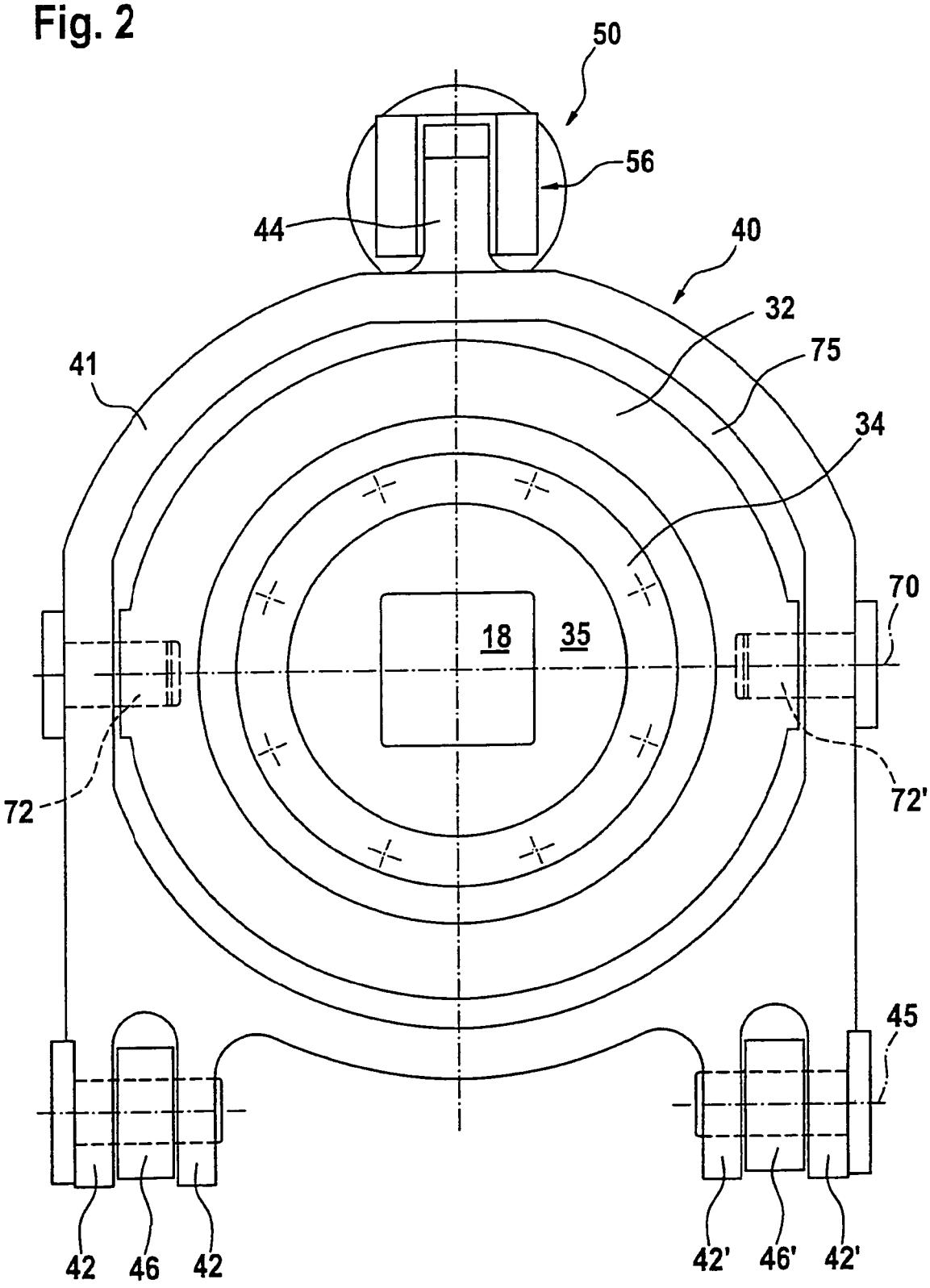
Figure 3:
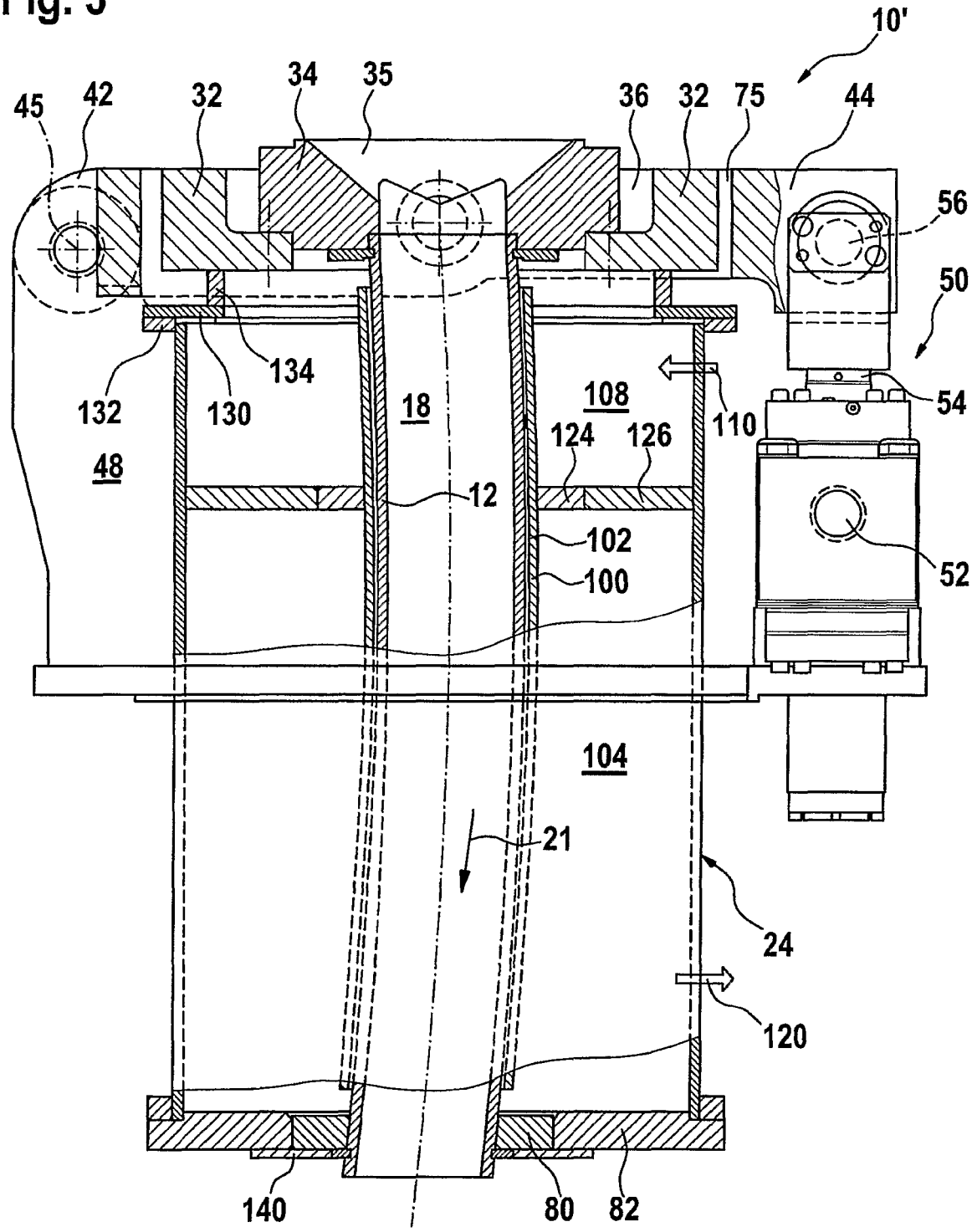

Preferred embodiments of the invention will now be described with reference to the accompanying drawings, wherein:

FIG. 1: is a longitudinal cross-section through a first embodiment of a continuous casting mould according to the invention;

FIG. 2: is a transversal cross-section through the continuous casting mould of FIG. 1;

FIG. 3: is a longitudinal cross-section through a second embodiment of a continuous casting mould according to the invention.

FIG. 1-3 show a continuous casting mould 10, 10' used, for example, in the continuous casting of metal billets, steel billets and the like. Such a mould comprises a mould tube 12 having an inner surface 14 and an outer surface 16. The inner surface 14 defines a casting channel 18 for the molten steel. Reference number 20 denotes the central axis of the casting channel 18. This casting axis 20 is contained in a vertical casting plane, which corresponds to the plane of FIG. 1. It may be straight or curved; in the latter case, it generally describes a circular arc with a radius of several meters. The mould tube 12 is generally a thick-walled copper tube. Its internal cross-section defines the cross-section of the cast product. The arrow denoted by reference number 21 indicates the direction of flow of the molten steel through the mould tube 12.

Reference number 24 globally identifies a cylindrical mould jacket surrounding the curved mould tube 12. In FIG. 1, this mould jacket 24 radially encloses a known spray cooling system 26 for vigorously cooling the mould tube 12. Such a spray cooling system 26 comprises a set of vertical cooling water pipes 28 extending from an annular collector (not shown in FIG. 1) at the bottom end to the top end of the mould jacket 24. Each of these pipes 28 includes a series of spray nozzles 29, which spray cooling water onto the mould tube 12.

Reference number 30 globally identifies a mould cover, which is located above the top end of the mould jacket 24. This mould cover 30 comprises an annular mould bearing 32 and a support flange 34 for the flange tube 12. The support flange 34 is arranged in a central cavity 36 of the annular mould bearing 32 and removably affixed thereto, e.g. by means of bolts 33. The upper end of the mould tube 12 is affixed to the support flange 34, which is a massive block forming a kind of central inlet funnel 35.

The continuous casting mould 10 further comprises an oscillating lever 40, which supports the mould cover 30 with the mould tube 12. As can best be seen on FIG. 2, the oscillating lever 40 comprises a central ring-shaped part 41, with, on a first side, two pairs of symmetrically arranged supporting arms 42, 42' and, on the opposite side, an actuation arm 44. The supporting arms 42, 42' are mechanically connected to pivot bearings 46, 46', so as to define a pivoting axis 45 for the oscillating lever 40. Referring now simultaneously to FIG. 1 and FIG. 2, it will be noted that the pivoting axis 45 is perpendicular to the casting plane, and that the pivot bearings 46, 46' are located on an outer support frame 48 laterally of the mould jacket 24.

The continuous casting mould 10 further includes a linear actuator 50, such as e.g. a hydraulic piston or linear electric motor. The latter is arranged outside the mould jacket 24, where it is pivotably supported via an articulated joint 52 by an outer support frame at the opposite side of the pivot bearings 46, 46'. It comprises a piston rod 54 that is connected to the actuation arm 44 of the oscillating lever 40 by means of an articulated joint 56. A hydraulic circuit (which is known per se and therefore neither shown nor described) subjects the piston rod 54 to a reciprocating motion with an amplitude of a few millimeters and a frequency of a few hertz, thereby oscillating the oscillating lever 40 about its horizontal pivoting axis 45. It will be appreciated that the linear actuator could be replaced by a rotary motor fitted with an eccentric producing the mechanical oscillations.

The annular mould bearing 32 is suspended within the central ring-shaped part 41 of the oscillating lever 40, so as to be capable of pivoting about a pivoting axis 70. This pivoting axis 70, which is parallel to the pivoting axis 45, is formed by two pivot bearings 72, 72', which connect the annular mould bearing 32 to the central ring-shaped part 41 of the oscillating lever 40. As there is an annular gap 75 between the central ring-shaped part 41 of the oscillating lever 40 and the annular mould bearing 32, the latter may pivot about the horizontal axis 70, when the oscillating lever 40 oscillates about its horizontal pivoting axis 45.

In FIG. 1, the mould cover 30 is connected in a sealed manner to the top end of the mould jacket 24 by means of an annular lip seal 90 affixed to the annular mould bearing 32. This annular lip seal 90 has a free resilient rim 92 that is radially pushed against a cylindrical inner wall 94 of the mould jacket 24, whereby the lip seal 90 circumferentially seals the gap between the mould jacket 24 and the mould cover 30, while allowing the mould cover 30 supporting the mould tube 12 to oscillate along the casting axis 20.

At the bottom end of the continuous casting mould 10, a ring element 80 is affixed to the lower end of the mould tube 12, and a bottom plate 82 is connected to the bottom end of the mould jacket 24. The bottom plate 82 includes a central opening in which the ring element 80 is arranged. A graphite ring 84 forms, within said central cut, an annular contact and guide surface between the ring element 80 and the bottom plate 82. This graphite ring 84 has a sealing function and also guides the oscillating ring element 80, whereby it imposes a well-defined oscillation path onto the lower end of the mould tube 12.

FIG. 3 shows a longitudinal cross-section through another embodiment of a continuous casting mould 10' according to the invention. This embodiment distinguishes over the embodiment of FIG. 1 mainly by the cooling system and the sealing elements. The cooling system of the mould of FIG. 3 is a continuous-flow cooling system instead of a spray cooling system as shown in FIG. 1. An inner jacket 100 surrounds the mould tube 12 over almost the whole of its height and forms, around the outer surface 16 of the ingot mould tube 12, a first annular space 102, providing a channel with a very narrow annular cross-section. The mould jacket 24 of the continuous casting mould 10 surrounds the inner jacket 100 and forms, with the latter, a second annular space 104, which surrounds the first annular space 102 and defines a channel with a significantly greater annular cross-section. The arrow 110 schematically represents a circuit for the supply of the cooling liquid. The cooling liquid enters through an annular supply chamber 108, located at the top end of the mould jacket 24, and passes into the first annular space 102. It flows through the latter at high speed before emerging into the second annular space 104. From here it is evacuated outside the mould jacket 24, as schematically indicated by arrow 120. To separate the annular supply chamber 108 in a sealed manner from the second annular space 104, the inner jacket 100 is fitted with an outer flange 124, which cooperates with an inner mating flange 126 of the mould jacket 24.

Instead of a lip seal 90, an annular diaphragm 130 connects the mould cover 30 in a sealed manner to the top end of the mould jacket 24. The outer rim of this annular diaphragm 130 is affixed in a sealed manner to an annular flange 132 of the mould jacket 24 and its inner rim is affixed in a sealed manner to an annular flange 134 of the annular mould bearing 32. The annular diaphragm 130 is elastically deformable and preferably made of rubber or a rubber like material. Metallic diaphragms or composite diaphragms are however not excluded.

At the bottom end of the continuous casting mould 10', the radial gap, which subsists between the ring 80 and the bottom plate 82, is sealed by an annular diaphragm 140.

The invention claimed is:

1. A continuous casting mold comprising:

a mold tube (12) forming a casting channel (18) along a casting axis (20), said mold tube (12) having an upper end and a lower end;

a mold jacket (24) surrounding said mold tube (12), said mold jacket (24) having a top end and a bottom end;

a cooling system (26) within said mold jacket (24) for cooling said mold tube (12);

an oscillating mold cover (30) associated with said top end of said mold jacket (24), said mold tube (12) being supported with its upper end by said oscillating mold cover (30); and a sealing element (90, 130) providing sealing between said oscillating mold cover (30) and said top end of said mold jacket (24);

characterized in that said oscillating mold cover (30) is pivotably supported by an oscillating lever (40) outside of said mold jacket (24), the casting mold comprises a pivoting axis (70) that is substantially parallel to a pivoting axis (45) of said oscillating lever (40), said oscillating mold cover (30) is located above said mold jacket (24) and said oscillating lever (40) has a central ring-shaped part (41) in which said oscillating mold cover (30) is pivotably supported.

2. The continuous casting mold as claimed in claim 1, wherein said oscillating lever (40) has on one side of said central ring-shaped part (41) supporting arms (42, 42') and on the opposite side thereof an actuation arm (44).

3. The continuous casting mold as claimed in claim 2, further comprising:

pivot bearings (46, 46') located laterally of said mold jacket (24), said supporting arms (42, 42') being mechanically connected to said pivot bearings (46, 46'), so as to define said pivoting axis (45) for said oscillating lever (40); and an oscillating device (50) arranged outside the mold jacket (24) at the opposite side of said pivot bearings (46, 46') and connected to said actuation arm (44) of said oscillating lever (40).

4. The continuous casting mold as claimed in claim 3, wherein said oscillating device is a linear actuator (50) that is pivotably supported outside said mold jacket (24) and connected via an articulated joint (56) to said actuation arm (44) of said oscillating lever (40).

5. The continuous casting mold as claimed in claim 1, wherein said mold cover (30) comprises: an annular mold bearing (32) pivotably supported by said oscillating lever (40), said annular mold bearing (32) including a central cavity (36); and a support flange (34) to which said upper end of the mold tube (12) is affixed, said support flange (34) being arranged in said central cavity (36) of said annular mold bearing (32) and removably affixed thereto.

6. The continuous casting mold as claimed in claim 5, wherein said support flange (34) forms a massive block forming a kind of central inlet funnel (35).

7. The continuous casting mold as claimed in claim 1, wherein said cooling system is a spray cooling system (26).

8. The continuous casting mold according to claim 7, wherein said sealing element is an annular lip seal (90).

9. The continuous casting mold according to claim 8, wherein said annular lip seal (90) is affixed to said oscillating mold cover (30) and has a free resilient rim (92) that is radially pushed against a cylindrical inner wall (94) of said mold jacket (24).

10. The continuous casting mold according to claim 7, further comprising:

a ring element (80) affixed to said lower end of said mold tube (12);

a bottom plate (82) connected to said bottom end of said mold jacket (24), said bottom plate including a central opening in which said ring element (80) is arranged; and a graphite ring (84) forming within said central opening an annular contact and guide surface between said ring element (80) and said bottom plate (82).

11. The continuous casting mold as claimed in claim 1, wherein said cooling system is a continuous-flow cooling system.

12. The continuous casting mold according to claim 8, wherein said sealing element is an annular diaphragm (130) mounted in a sealed manner between said mold cover (30) and said top end of said mold jacket (24).

13. The continuous casting mold according to claim 1, wherein the oscillating lever (40) is connected to the oscillating mold cover (30).

* * * * *

UNITED STATES PATENT AND TRADEMARK OFFICE

CERTIFICATE OF CORRECTION

PATENT NO. : 7,694,716 B2
APPLICATION NO. : 11/630754
DATED : April 13, 2010
INVENTOR(S) : Emile Lonardi et al.

It is certified that error appears in the above-identified patent and that said Letters Patent is hereby corrected as shown below:

On the Title page

Item {30} Foreign Application Priority Data should read

June 24, 2004 (LU) ..... 91086

Signed and Sealed this

Twenty-third Day of November, 2010

David J. Kappos

David J. Kappos
*Director of the United States Patent and Trademark Office*